US005306871A

United States Patent [19]

Lai

[11] Patent Number: 5,306,871

[45] Date of Patent: Apr. 26, 1994

[54] ELECTRICAL CORD ASSEMBLY FOR LIGHTING FIXTURE

[76] Inventor: Shih-Wang Lai, P.O. Box 55-1670, Taipei, Taiwan

[21] Appl. No.: 956,973

[22] Filed: Oct. 6, 1992

[51] Int. Cl.[5] ..... F21V 21/22; F21V 23/00

[52] U.S. Cl. ..... 174/65 R; 174/50; 174/52.2; 362/250; 362/431

[58] Field of Search ..... 174/50, 52.1, 52.2, 174/65 R; 361/600, 601, 602, 622; 362/250, 267, 418, 431

[56] References Cited

U.S. PATENT DOCUMENTS 3,034,098 5/1962 Clasen ..... 362/250 X 4,363,084 12/1982 Dimiceli ..... 362/431 X

*Primary Examiner*—Leo P. Picard

*Assistant Examiner*—David Tone

[57] ABSTRACT

An electrical cord assembly for lighting fixture includes: a main cord connected to a power source, a switch box connected with the main cord secured on a supporting stand, at least a lamp cord branched from the main cord through the switch box and connected to at least a lamp secured on the stand through a lamp adapter, wherein the switch box is formed by integrally molding an outer jacket on an inner box for ensuring a water proof property for the power connection, and the lamp adapter is also well shielded for water proof purpose, thereby forming an electrical cord system easily assembled for saving assembly labor cost and for providing a lighting fixture for a quicker lighting service.

8 Claims, 7 Drawing Sheets

ELECTRICAL CORD ASSEMBLY FOR LIGHTING FIXTURE

BACKGROUND OF THE INVENTION

A conventional lighting fixture for mounting a plurality of lamps or lights on a stand is provided with an electrical cord system which may include a main cord connected with several branched cords for powering the lamps. Each lamp is connected with a branched cord powered from the main cord by means of a switch box having a push button switch provided on each switch box for switching on or off the lamp. However, for connecting the cords in such a conventional lighting fixture, it requires complex procedures for connecting the cords for their power supply, causing inconvenience for a lighting engineering. Meanwhile, the lighting fixture provided for exterior activities outside a room may be subjected to rain or moisture attack and the conventional switch boxes of the lighting fixture are always not water proof, thereby being vulnerable to be damaged by rainy water or moisture or possibly causing electrical shock accident when the electrically connecting parts of the lighting fixture is moistened and contacted by any persons who touch such a wet lighting fixture.

It is therefore expected to disclose an electrical cord system having water-proof property and easier assembly to be installed on a lighting fixture.

SUMMARY OF THE INVENTION

The object of the present invention is to provide an electrical cord assembly for lighting fixture including: a main cord connected to a power source, a switch box connected with the main cord secured on a supporting stand, at least a lamp cord branched from the main cord through the switch box and connected to at least a lamp secured on the stand through a lamp adapter, wherein the switch box is formed by integrally molding an outer jacket on an inner box for ensuring a water proof property for the power connection, and the lamp adapter is also well shielded for water proof purpose, thereby forming an electrical cord system easily assembled for saving assembly labor cost and for providing a lighting fixture for a quicker lighting service.

DETAILED DESCRIPTION

Figure 1:
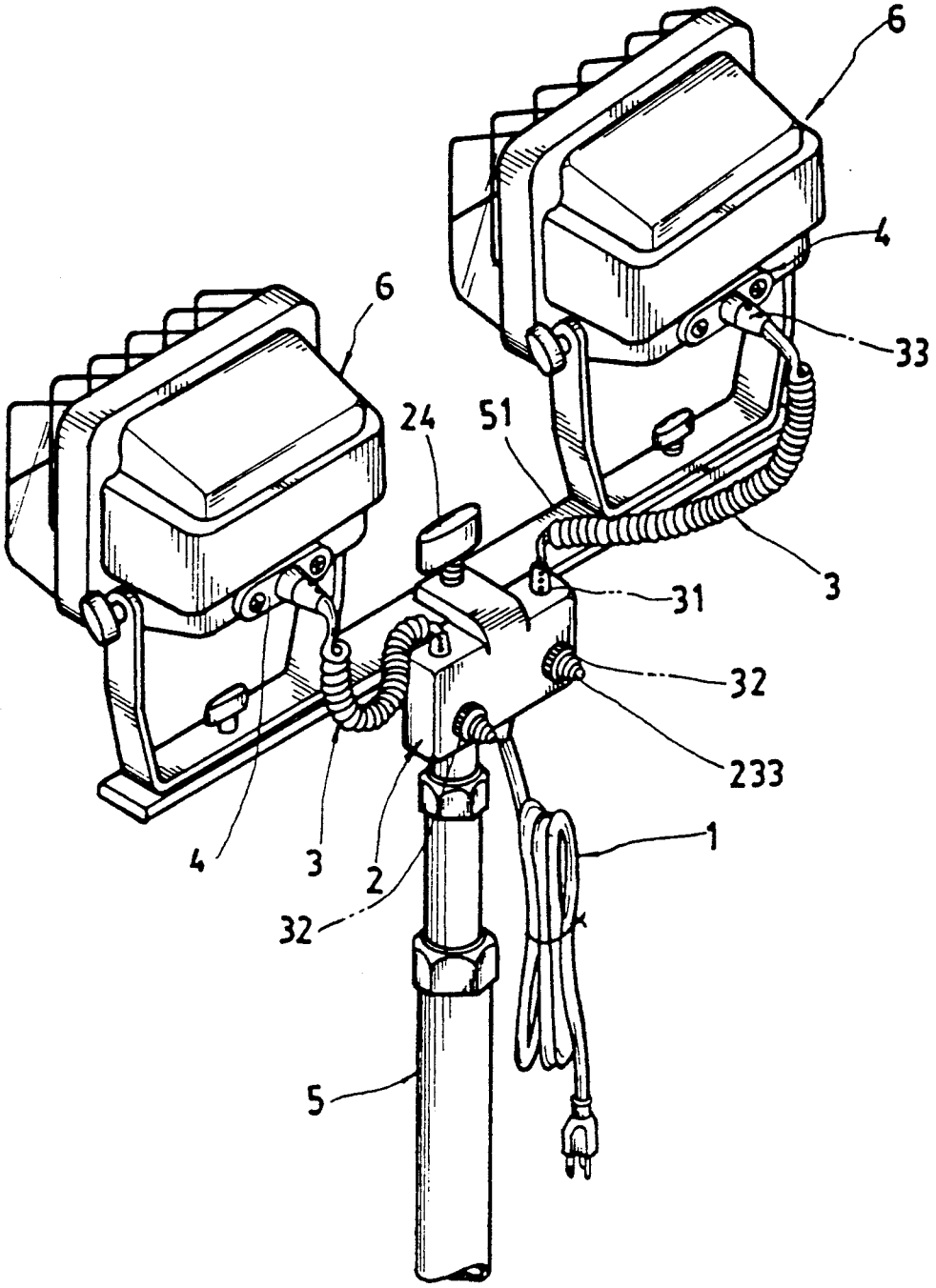
FIG. 1 is a perspective view of the present invention when assembled.

As shown in FIGS. 1–5, the present invention comprises: a main cord 1, a switch box 2, at least a lamp cord 3 each lamp cord 3 connected between the switch box 2 and a lamp 6 by a lamp adapter 4, and a supporting stand 5 for securing the switch box 2 and the lamp 6 on the stand 5.

The switch box 2 includes: an inner box 21 having a first lower semi-circular hole 210 formed in a lower portion of the inner box, and at least a first upper semi-circular hole 211 formed in an upper portion of the box; a box cover 22 having a second lower semi-circular hole 220 formed in a lower portion of the cover 22 combinably fastening the main cord 1 with the first lower semi-circular hole 210 formed in the box 21, at least a second upper semi-circular hole 221 formed in an upper portion of the cover 22 combinably fastening a lamp cord 3 with the first upper semi-circular hole 211 formed in the box 21, and a button socket 222 recessed in the cover 22 for storing at least a push button switch 32 connected between the main cord 1 and the lamp cord 3 in the button socket 222; and an outer jacket 23 integrally formed by plastic molding process for coating, sealing and encasing the inner box 21 and the box cover 22 within the outer jacket 23, with each push button switch 32 protruding outwardly a button portion 321 through a button hole **222*a* formed in the box cover 22 communicating the button socket 222 to be integrally secured with a button cap 233** which is preferably made of flexible elastomeric material having electrically insulative property.

Figure 2:
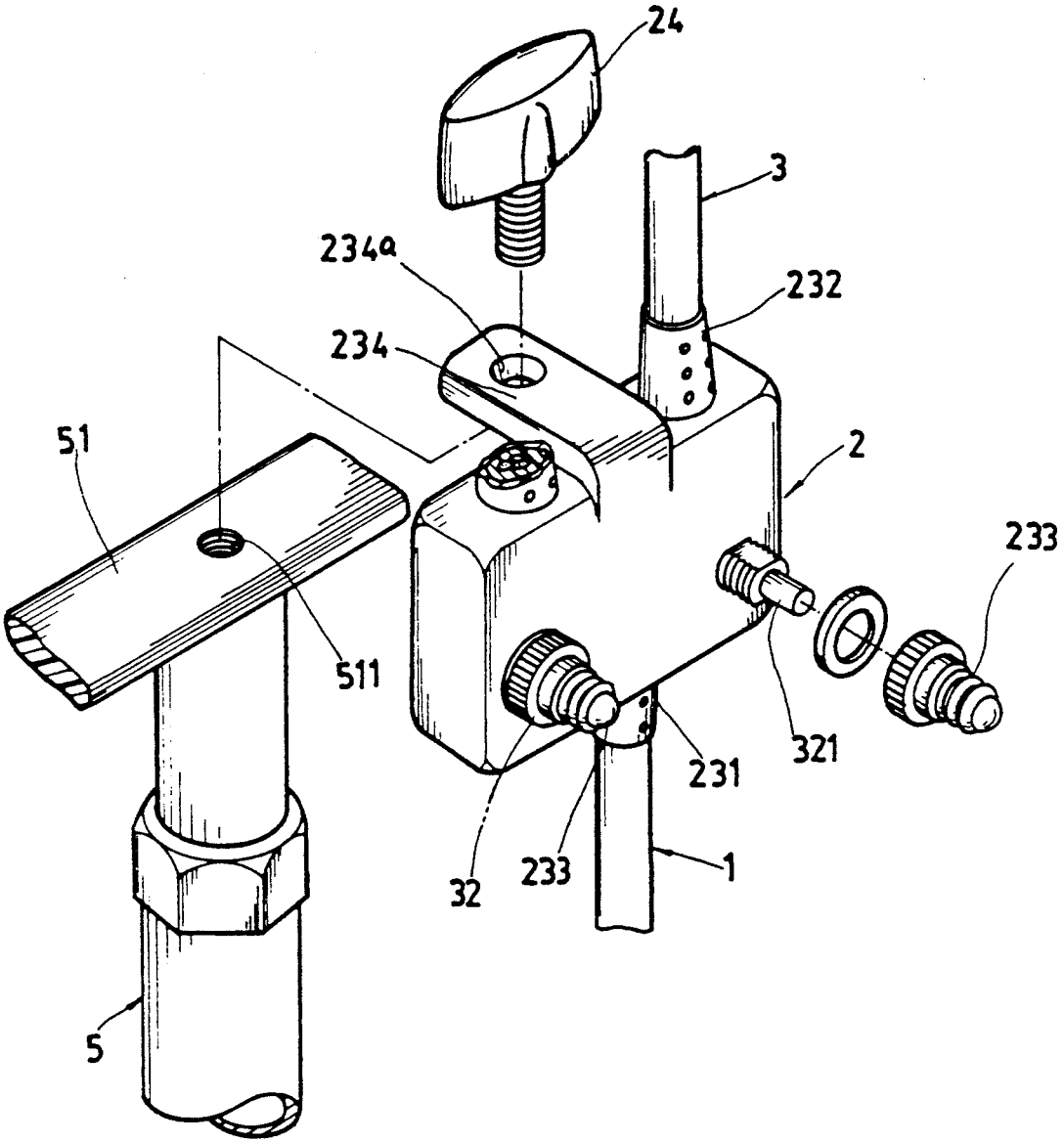
FIG. 2 is a partial illustration showing a switch box with a supporting stand of the present invention.
Figure 3:
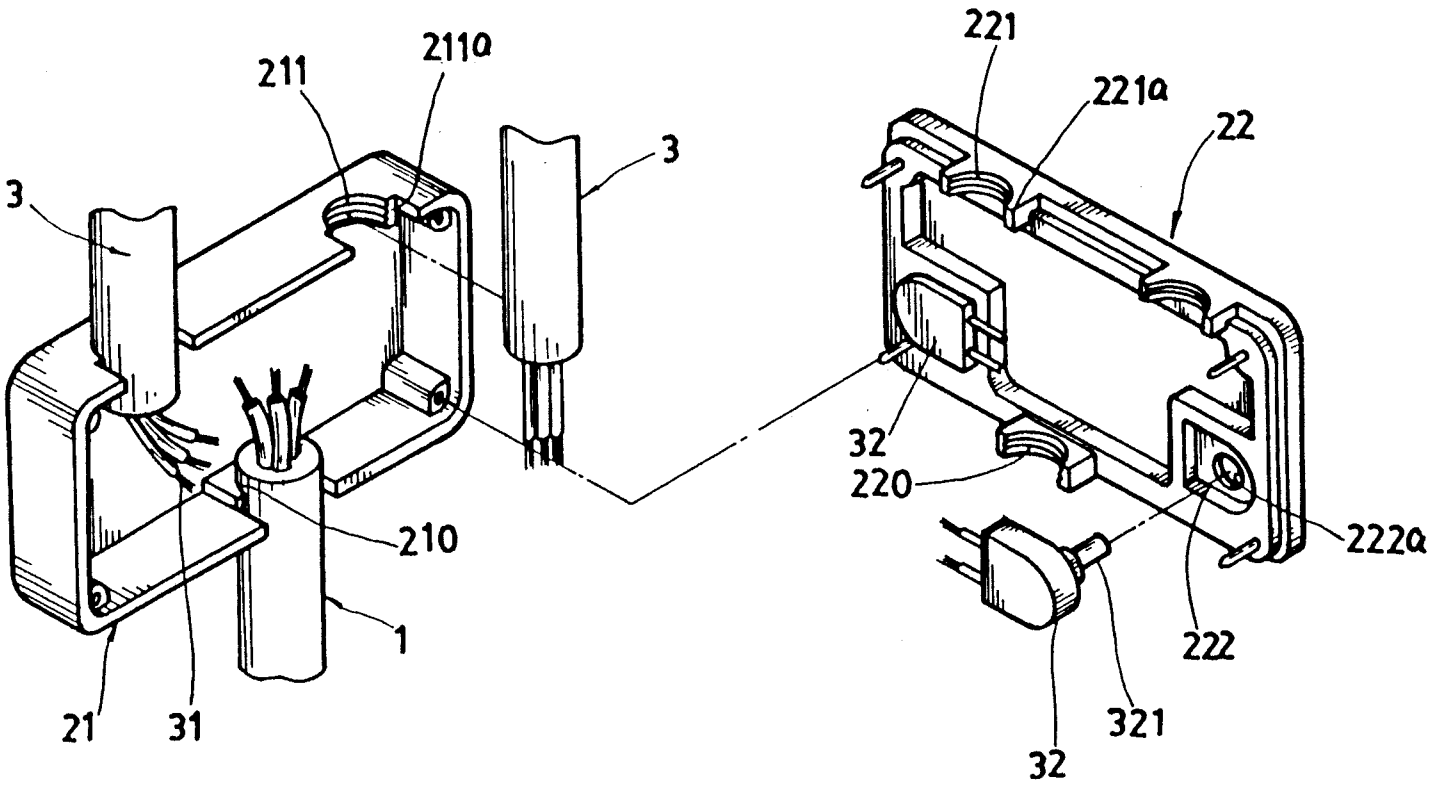
FIG. 3 is an exploded view showing an inner box and its cover of the switch box of the present invention.
Figure 4C:
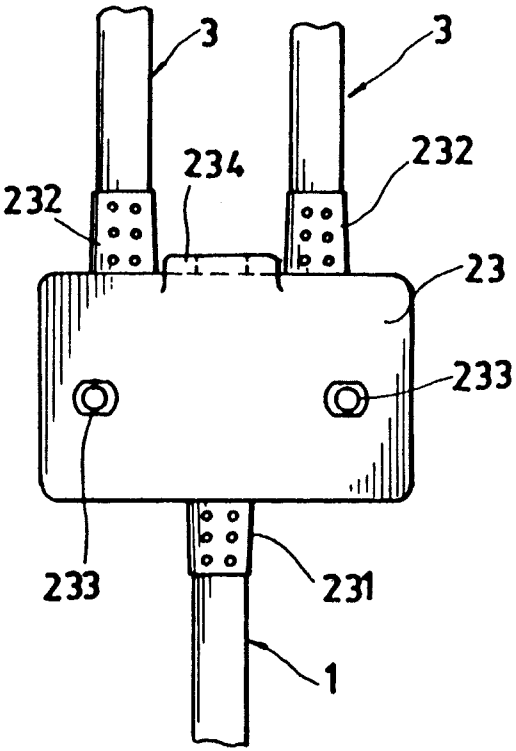
FIG. 4A–4C show the steps for integrally forming the switch box in accordance with the present invention.
Figure 4B:
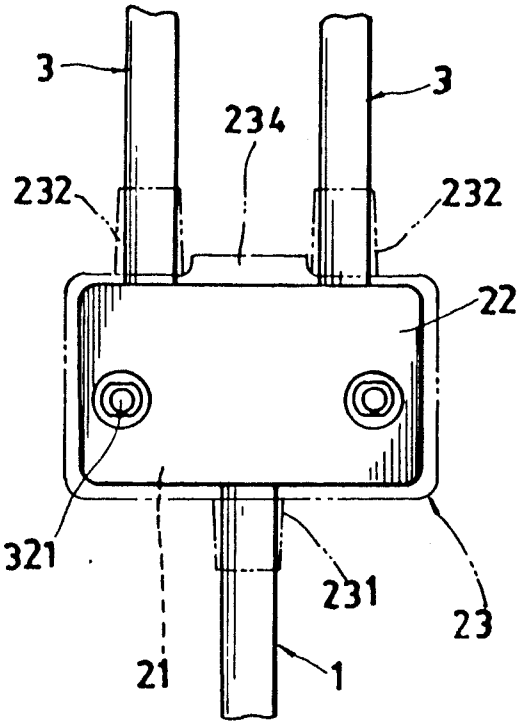
Figure 4A:
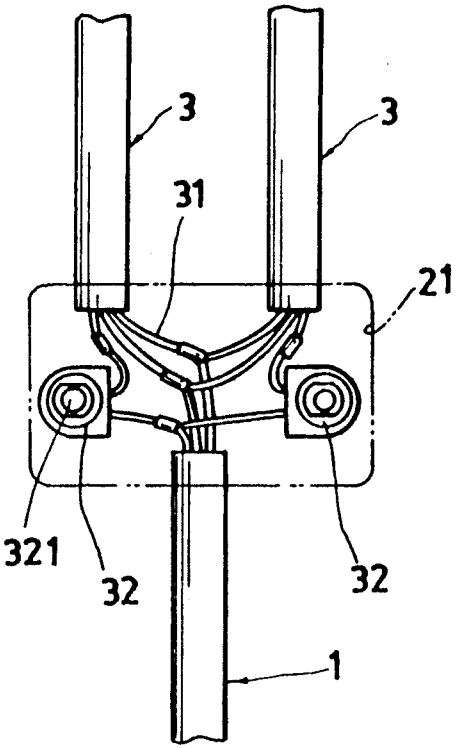
Figure 5:
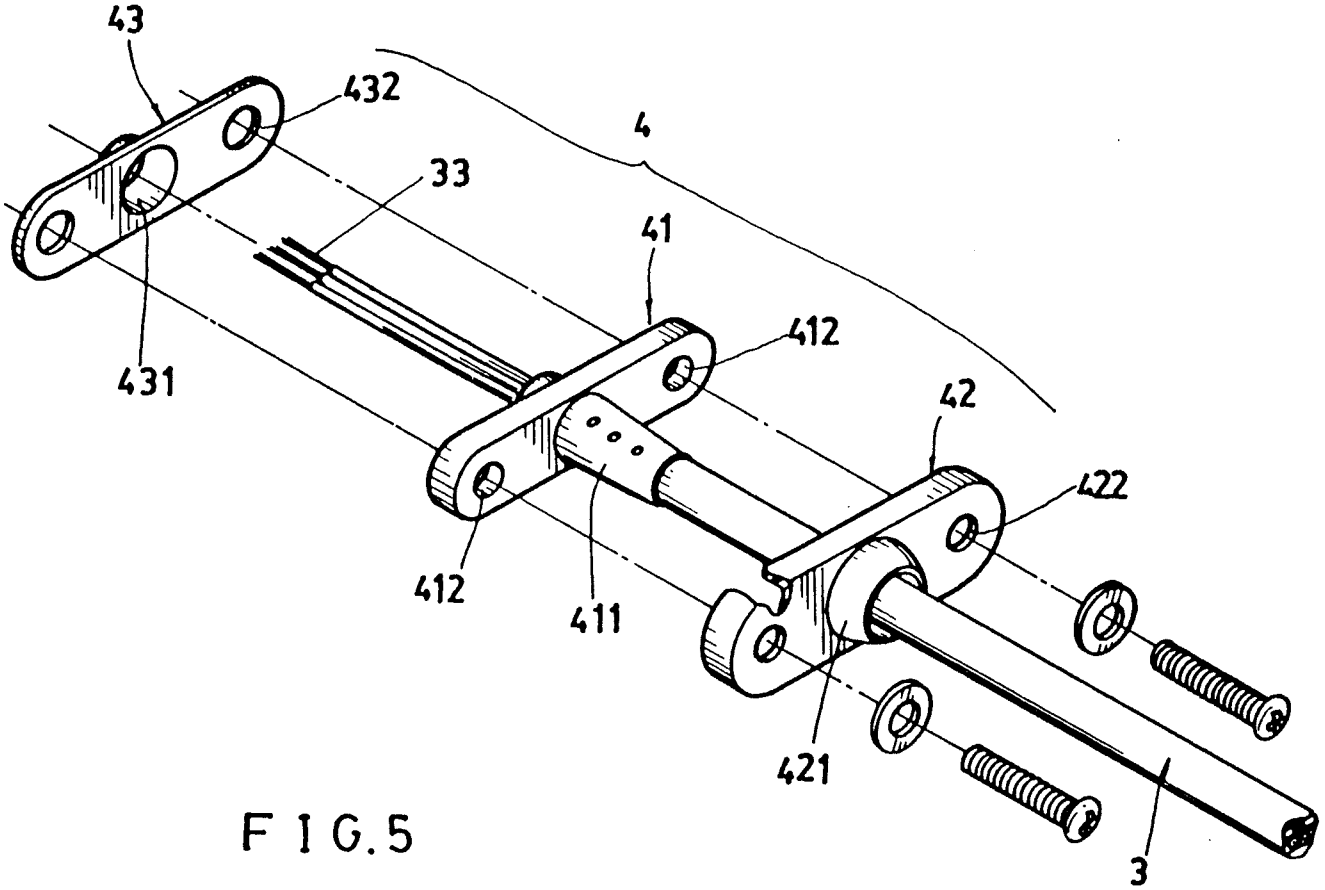
FIG. 5 shows an exploded view of the lamp adapter of the present invention.
Figure 6C:
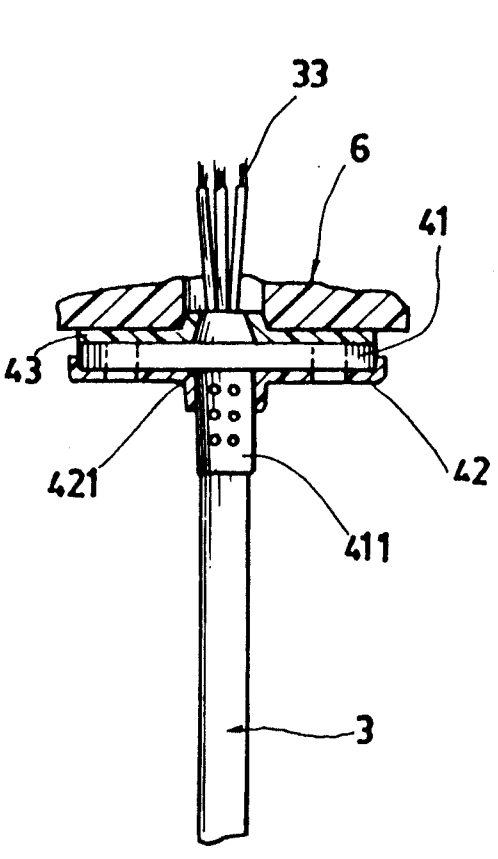
FIG. 6A–6C show the steps for assembling each lamp adapter on each lamp in accordance with the present invention.
Figure 6B:
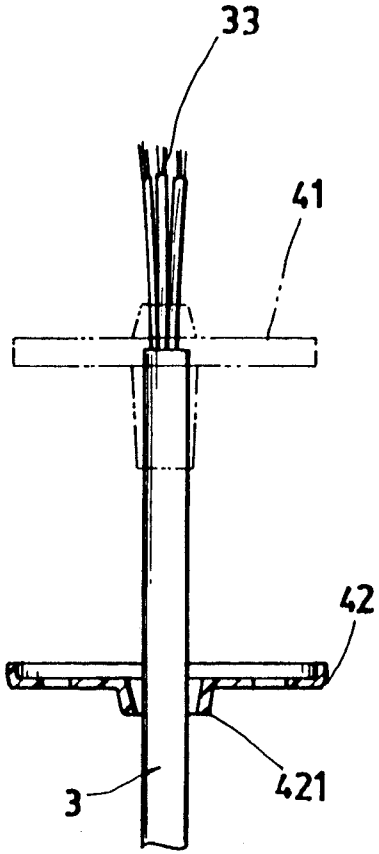
Figure 6A:
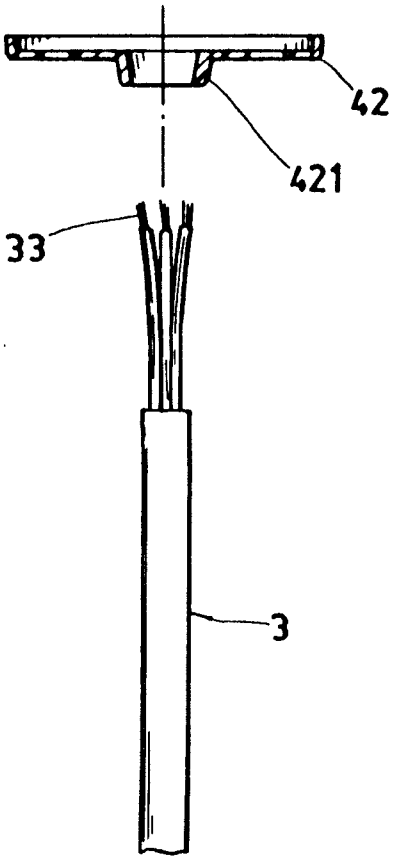

The outer jacket 23 is formed with a bracket 234 having a screw hole **234*a* formed in the bracket 234 engageable with a fixing bolt 24 for securing the switch box 2 on the supporting stand 5 or on a branch lever 51 of the stand by engaging the bolt 24 into the screw hole 234*a* of the bracket 234 and a screw hole 511 formed in the stand 5 as shown in FIG. 2**.

The first upper semi-circular hole 211 of the inner box 21 has a pair of notches **211*a* formed on two opposite sides of the first upper semi-circular hole 211 in the inner box 21 engageable with a pair of lugs 221*a* formed on two opposite sides of the second upper semi-circular hole 221 on the box cover 22 for a firm coupling of the first and second upper semi-circular holes 211, 221**.

Each said semi-circular hole 211, 221, 210, 220 in the inner box 21 and in the box cover 22 may be formed with a plurality of corrugated threads in the semi-circular hole for firmly fastening the cord 1 or 3 therein.

There are two sets of the lamps 6 and the lamp cords 3 respectively as shown in the drawing figures, but not limited in this invention.

The outer jacket 23 includes a lower reinforcing sleeve 231 encasing a connection or junction portion of the main cord 1 with the switch box 2, and at least an upper reinforcing sleeve 232 encasing a connection or junction portion of the lamp cord 3 with the switch box 2 for reinforcing the cords 1, 3 and for water proof purpose therefor.

Each lamp cord 3 has its input terminal 31 connected with the main cord 1 through the push button switch 32 formed in the switch box 2, and has an output terminal 33 of the lamp cord 3 connected to each lamp 6 secured on the branch lever 51 of the supporting stand 5 by a lamp adapter 4.

Each lamp adapter, as shown in FIGS. 5 and 6A–6C, includes: a connector base 41 having a central reinforcing sleeve 411 for sealably encasing the output terminal 33 of the lamp cord 3 and two screw holes 412 in the base 41; a shielding cover 42 having a central sleeve fastener 421 for fastening the central reinforcing sleeve 411 of the connector base 41 and two screw holes 422 in the cover 42; and a heat-resistant packing member 43 preferably made of silicon rubber having a central cord hole 431 for passing through the lamp cord 3 therein for connecting the lamp cord 3 with the lamp 6, and two screw holes 432 in the packing member 43, whereby upon an insertion of two screws through all the screw holes 422, 412, 432 in the cover 42, base 41 and packing member 43, the lamp adapter 4 can be secured to the lamp 6 such as a rear portion of a lamp shade as shown in FIG. 1.

Figure 7:
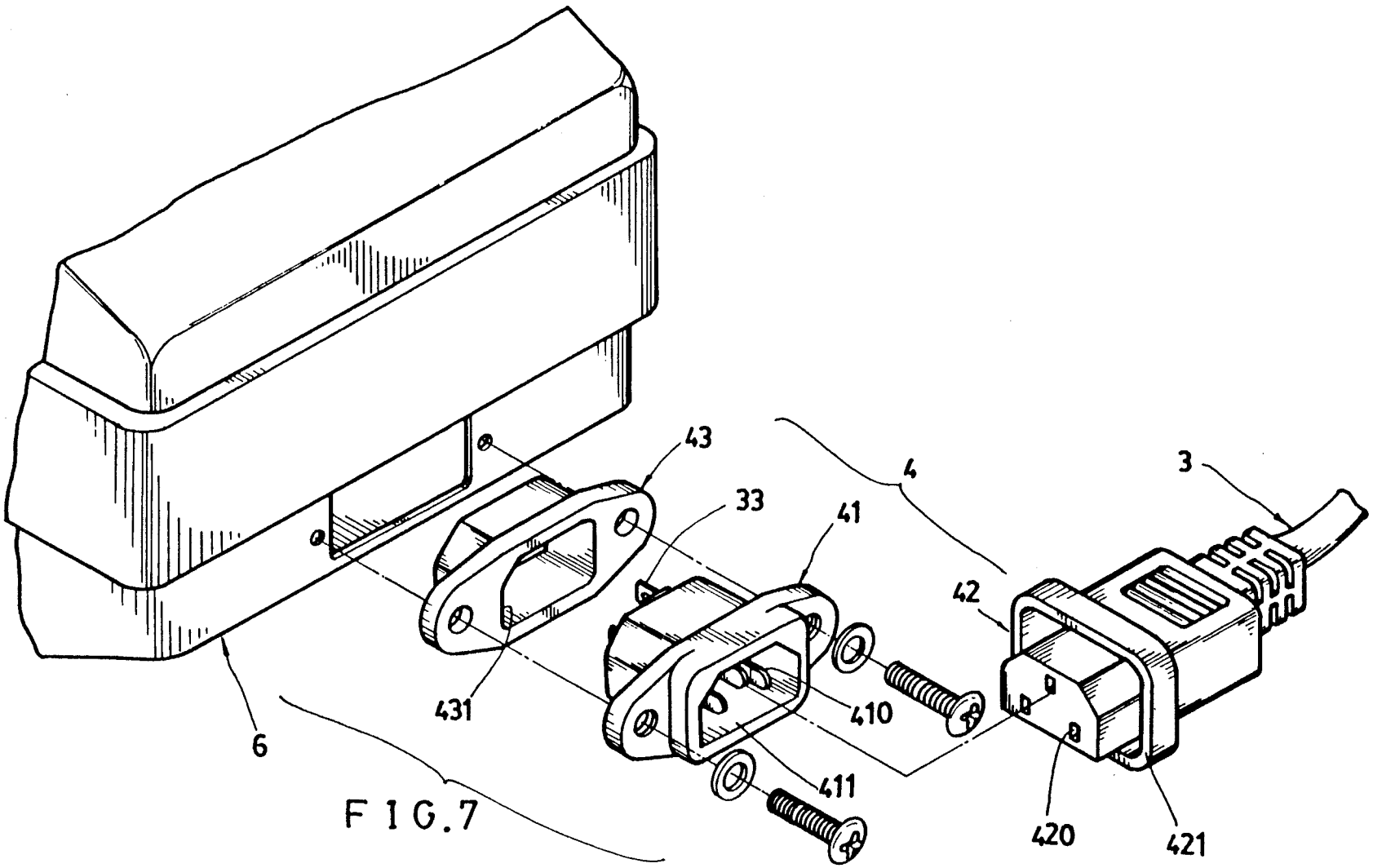
FIG. 7 shows another preferred embodiment of the lamp adapter of the present invention.

As shown in FIG. 7, the lamp adapter 4 may be modified to include: a connector base 41 having a plurality of plug pins 410 in the base 41 connected with an output terminal 33 of the lamp cord 3 and a reinforcing sleeve 411 disposing around the pins 410; a shielding cover 42 having a plurality of pin sockets 420 recessed in the cover 42 engageable with the pins 410 in the base 41 and electrically connected to the lamp cord 3 and having a sleeve fastener 421 disposing around the pin sockets 420 engageable with the reinforcing sleeve 411 of the base 41 for coupling the cover 42 with the base 41; and a packing member 43 preferably made of silicon rubber for heat resistant purpose retained between the base 41 and the lamp 6 when securing the base 41 and the cover 42 with the lamp 6.

The present invention is superior to an electrical cord system of a conventional lighting fixture with the following advantages:

1. The switch box 2 includes an integrally formed outer jacket 23 encasing the inner box 21 for ensuring a water-proof of the electrical cord system for safety purpose.
2. Easier assembly of the power supply system for a lighting fixture can be achieved by this invention for reducing labor cost, and for a convenient assembly and better maintenance for an electrical cord system especially beneficial for an exterior lighting use.

I claim:

1. An electrical cord assembly for lighting fixture comprising:

a supporting stand;

a main cord connected with a power supply;

a switch box secured on said supporting stand including an inner box for storing at least a push button switch in said box, a box cover shielding the inner box for fastening the main cord in between the inner box and said box cover, and an outer jacket integrally formed on said inner box and said box cover to encase said inner box and said box cover in said outer jacket;

at least a lamp cord having its input terminal connected with said main cord through said push button switch in said switch box and having an output terminal of the lamp cord connected to a lamp secured on said supporting stand by a lamp adapter.

2. An electrical cord assembly according to claim 1, wherein said switch box includes: said inner box having a first lower semi-circular hole formed in a lower portion of the inner box, and at least a first upper semi-circular hole formed in an upper portion of the box; a box cover having a second lower semicircular hole formed in a lower portion of the cover combinably fastening the main cord with the first lower semi-circular hole formed in the box, at least a second upper semi-circular hole formed in an upper portion of the cover combinably fastening the lamp cord with the first upper semi-circular hole formed in the box, and a button socket recessed in the cover for storing at least a push button switch connected between the main cord and the lamp cord in the button socket; and said outer jacket integrally formed by plastic molding process for coating, sealing and encasing the inner box and the box cover within the outer jacket, with each said push button switch protruding outwardly a button portion through a button hole formed in the box cover communicating the button socket to be integrally secured with a button cap.

3. An electrical cord assembly according to claim 2, wherein said outer jacket is formed with a bracket having a screw hole formed in the bracket engageable with a fixing bolt for securing the switch box on the supporting stand by engaging the bolt into the screw hole of the bracket and a screw hole formed in the stand.

4. An electrical cord assembly according to claim 2, wherein said first upper semi-circular hole of the inner box has a pair of notches formed on two opposite sides of the first upper semi-circular hole in the inner box engageable with a pair of lugs formed on two opposite sides of the second upper semi-circular hole on the box cover for a firm coupling of the first and second upper semi-circular holes for the inner box and the box cover.

5. An electrical cord assembly according to claim 2, wherein each said semi-circular hole in the inner box and in the box cover is formed with a plurality of corrugated threads in the semi-circular hole for firmly fastening the main and lamp cords therein.

6. An electrical cord assembly according to claim 2, wherein said outer jacket includes a lower reinforcing sleeve encasing a connection portion of the main cord with the switch box, and at least an upper reinforcing sleeve encasing a connection portion of the lamp cord with the switch box for reinforcing the main and lamp cords and for water proof purpose.

7. An electrical cord assembly according to claim 1, wherein each said lamp adapter includes: a connector base having a central reinforcing sleeve for sealably encasing the output terminal of the lamp cord and two screw holes in the base; a shielding cover having a central sleeve fastener for fastening the central reinforcing sleeve of the connector base and two screw holes in the cover; and a heat-resistant packing member having a central cord hole for passing through the lamp cord therein for connecting the lamp cord with the lamp, and two screw holes in the packing member, whereby upon an insertion of two screws through the screw holes respectively formed in the cover, the base and the packing member, the lamp adapter can be secured to the lamp.

8. An electrical cord assembly according to claim 1, wherein the lamp adapter includes: a connector base having a plurality of plug pins in the base connected with an output terminal of the lamp cord and a reinforcing sleeve disposing around the pins; a shielding cover having a plurality of pin sockets recessed in the cover engageable with the pins in the base and electrically connected to the lamp cord and having a sleeve fastener disposing around the pin sockets engageable with the reinforcing sleeve of the base for coupling the cover with the base to be secured to the lamp.

* * * * *